United States Patent [19]

Miller

[11] 4,063,574

[45] Dec. 20, 1977

[54] LOOM

[76] Inventor: Joyce Ann Miller, 2627 Haverford Road, Columbus, Ohio 43220

[21] Appl. No.: 713,876

[22] Filed: Aug. 12, 1976

[51] Int. Cl.[2] ..... D03D 29/00

[52] U.S. Cl. ..... 139/29; 139/33

[58] Field of Search ..... 139/29–34; 28/15; 66/4, 1 A

[56] References Cited

U.S. PATENT DOCUMENTS

| | | | |
|---|---|---|---|
| 829,474 | 8/1906 | Hopper | 139/33 |
| 1,464,847 | 8/1923 | Hryz | 139/33 X |
| 1,519,023 | 12/1924 | Neergaard | 139/33 |
| 1,995,384 | 3/1935 | Fletcher | 139/34 X |
| 2,193,558 | 3/1940 | Gallinger | 139/33 |
| 2,723,439 | 11/1955 | Doniger | 28/15 |
| 2,817,366 | 12/1957 | Sakano | 139/33 X |

FOREIGN PATENT DOCUMENTS

| | | | |
|---|---|---|---|
| Ad.38,726 | 4/1931 | France | 139/29 |
| 485,180 | 10/1929 | Germany | 139/33 |
| 195,930 | 7/1938 | Switzerland | 139/29 |

*Primary Examiner*—James Kee Chi

*Attorney, Agent, or Firm*—Frank H. Foster

[57] ABSTRACT

A simple backstrap type loom consisting of a rigid heddle, two identical end boards, that will be called the warp board and the woven web board, and four flexible laces. The boards hold the warp and finished weaving under tension, when tied with the flexible laces to stationary objects, and the rigid heddle is then used to make the shed in the warp.

4 Claims, 5 Drawing Figures

LOOM

BACKGROUND OF THE INVENTION

This invention relates to the field of weaving, and more particularly is designed to be low in cost, portable, and simple to operate. This loom was invented while working with children and beginning weavers often in a classroom situation where there is:

A. A need to have many simple low cost looms in operation in a small space.

B. A need for compact safe storage of work in progress so that put away and set up is easy and quick.

C. A need to have several people work on the same loom, at the same time, or in quick sucession with little waste of time or warp between projects.

D. A need for a loom that will allow the use of a wide variety of weft materials.

SUMMARY OF THE INVENTION

The main objects of the present invention is to meet the needs A.), B.), C.), and D.) as outlined in the background of the invention. This is accomplished by the special design of the two end pieces of the loom, that together with the rigid heddle constitute a simple loom. For a better understanding of the way this works, and its many advantages, reference should be had to the drawings and the detailed description in the preferred embodiment. Various other objects, advantages and features of the invention are pointed out in the claims.

BRIEF DISCRIPTION OF THE DRAWINGS

FIG. 1 The loom in use, with warp held under tension.

FIG. 2 Parts of the loom.

FIG. 3 Groups of knotted warps as placed in slots of an end board.

FIG. 4 Materials winding up on woven web board with projections past the edge of the board and beyond the warp width.

FIG. 5 The loom tied as for storage of work in progress.

DESCRIPTION OF THE PREFERRED EMBODIMENT

Figure 1:
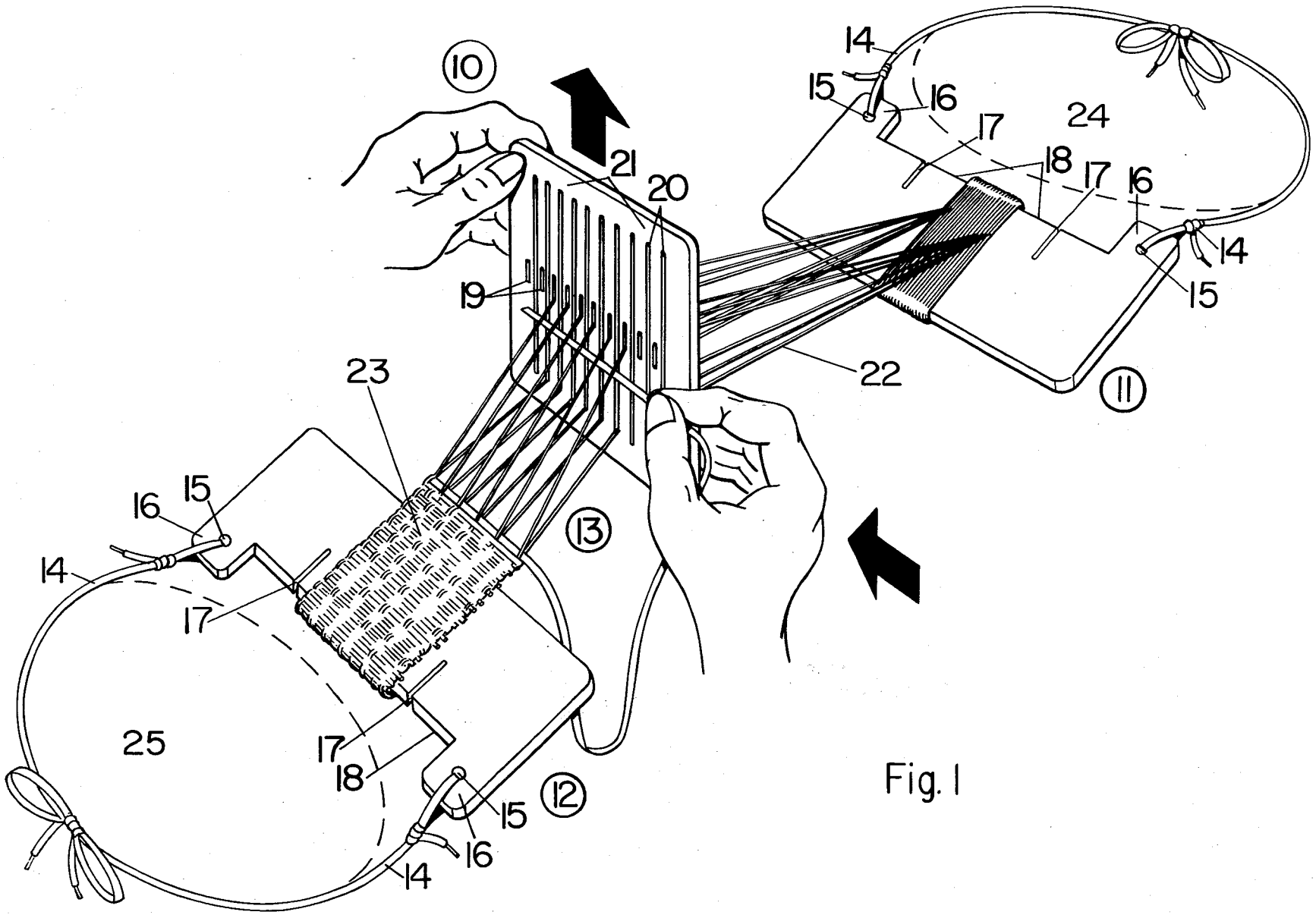
Figure 2:
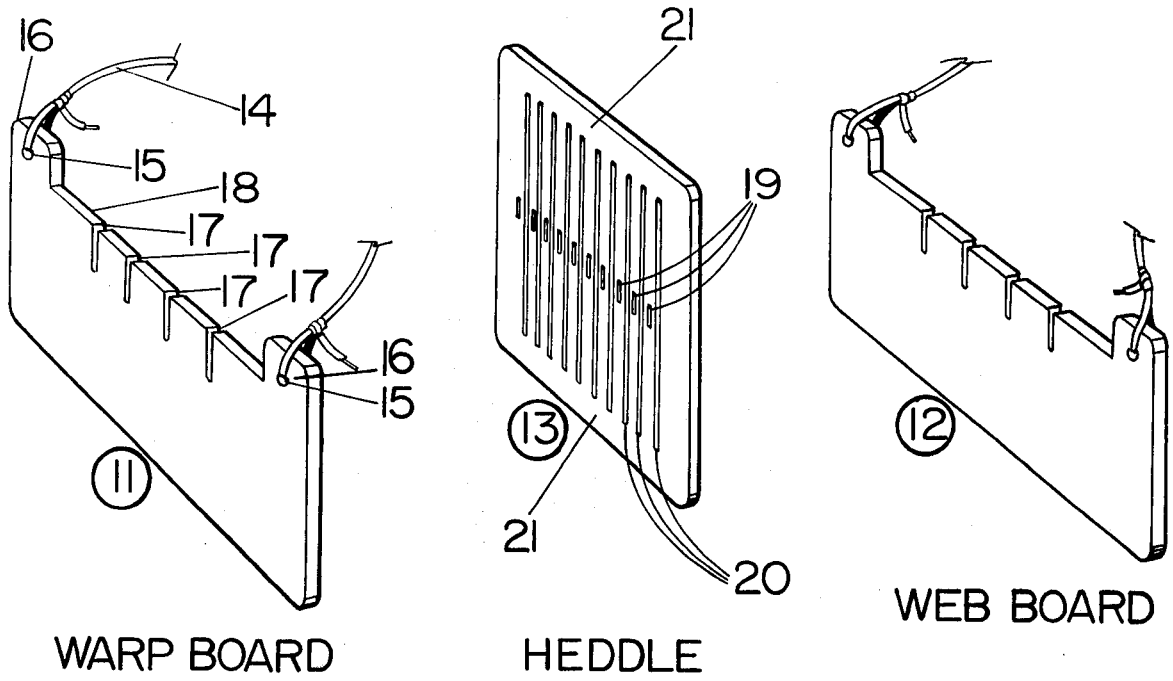

Referring now to FIG. 1 and FIG. 2, a loom 10 embodying the invention is shown to be comprised of two end pieces or boards 11 and 12 and a rigid heddle 13. The end board 12 holds the woven material 23 and an itentical board 11 holds the warp 22. These pieces 11 and 12, each have two projections 16 with holes 15 where flexible laces 14 are attached, and then these laces 14 are tied to suitable fixed objects 24 and 25, to create tension on the warp 22 so that the rigid heddle 13 can make two different sheds. The heddle 13 makes one shed when it is pulled up, and the warps in the oval holes 19 are on top, and the alternate shed when pulled down and warps in the slots 20 are on top. The border 21 of the rigid heddle 13 is useful to hold while moving the heddle 13 up and down.

Figure 3:
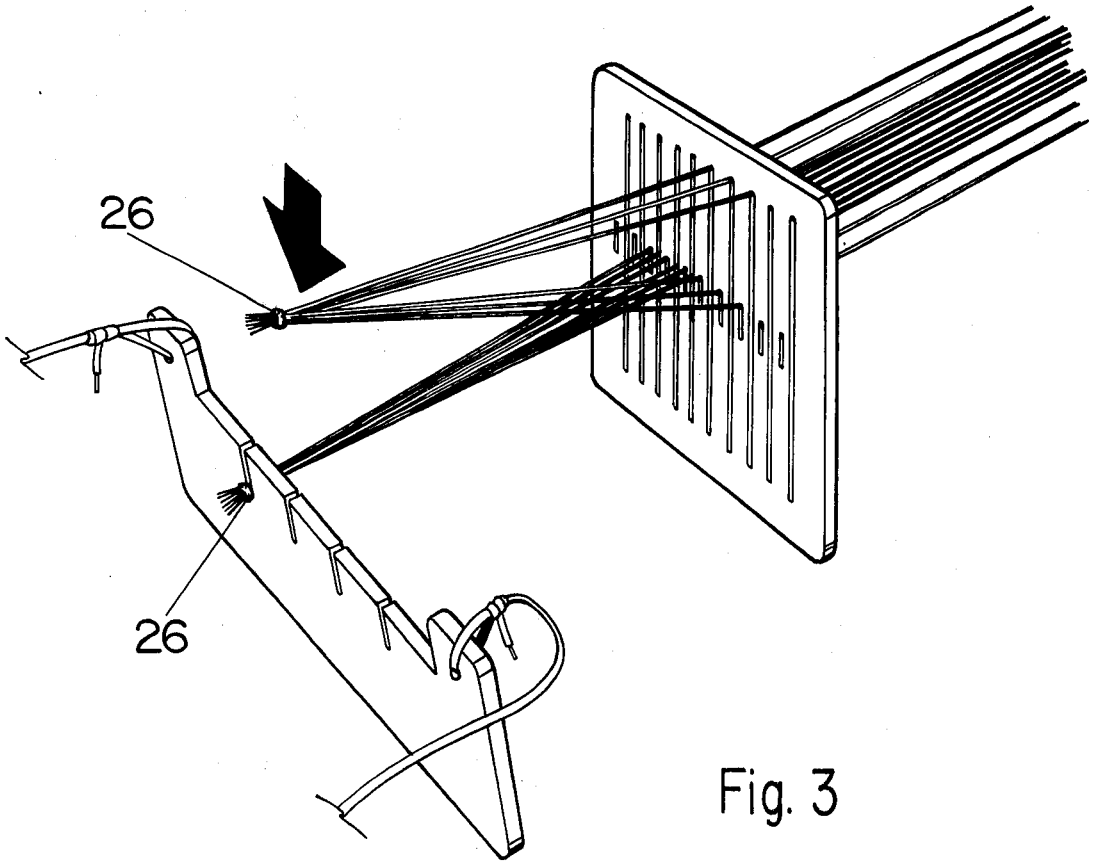

Refer now to FIG. 3 for a view of how the slots 17 that are on the inside edge 18 of the end boards 11 and 12 have been designed to slip a group of warp ends, that have been knotted together 23, into. These slots hold the warp ends in a positive way without slipping being possible when the end pieces or boards 11 and 12 are held under tension, as provided when the flexable laces are tied to fixed objects 24 and 25. This provides a very simple way to equalize warp length and tension by pulling the warp ends tight and making the knots 23 at about the same distance in each group.

Figure 4:
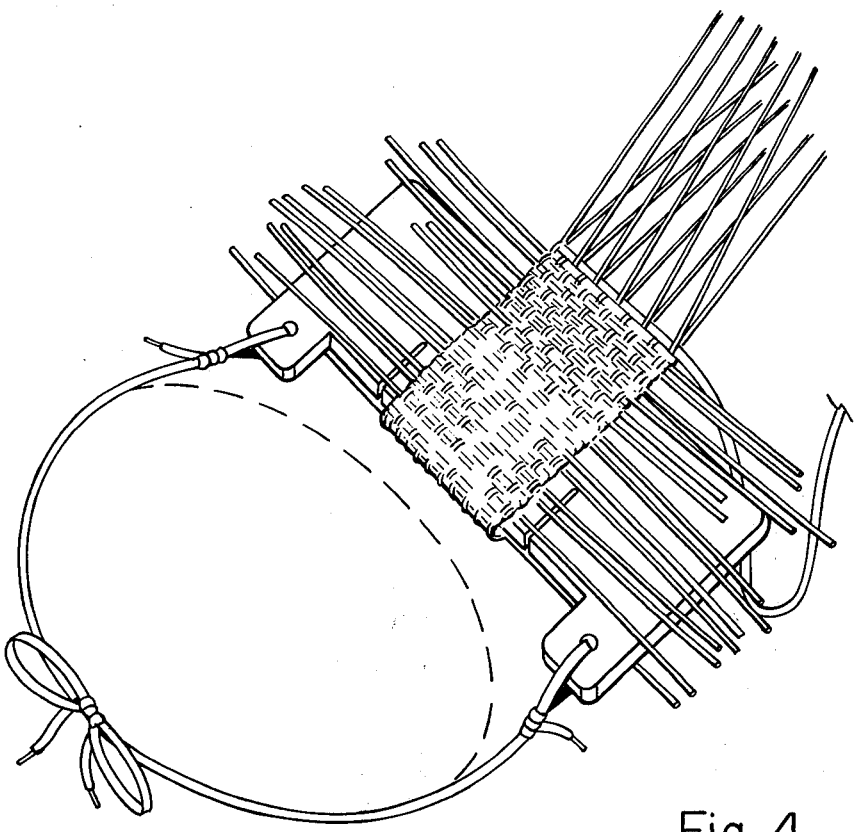

FIG. 4 illustrates how weft materials may be used that are both bulky and longer than the width of the weaving as they can be wound up without damage because the projections 16 and laces 14 of the end board fit right between laterally extended materials. Very little tension is on the finished work 23 at any point except just at the point where it crosses the inside edge of the end board 12.

Low cost is achieved by the simplicity of the three main rigid pieces 11, 12, and 13 and flexable laces 14 which do not require attachment or assembly during manufacture.

The loom 10 is easy to warp and easy to use because of the design of the end boards 11 and 12. To warp the loom: 1.) Thread one end of each warp thread 22 through the holes 19 and the slots 20 of the rigid heddle, 2.) Tie these warp ends together into groups with knots FIG. 3 26, 3.) Slip these knots 26 into slots 17 in the warp board 11, 4.) Turn the warp board 11 over and over until most of the warp 22 is wound onto the warp board 11, 5.) The other ends of the warp are now knotted in groups in the same manner 26, and the knots 26 slipped into the slots of the woven web board 12. The pieces 11 and 12 can now be tied down by their laces 14 to two fixed objects 24 and 25 or to one fixed object 24 and the weaver, so that the warp 22 is under tension and the loom 10 is ready for weaving. The laces 14 provide a great flexibility in the tension as they may be pulled to any tightness before tieing. To weave: raise the heddle 13, insert weft in the open shed, pull weft forward into place with the heddle 13, lower the heddle 13, insert weft in the alternate shed, pull weft forward into place beside the last weft, and repeat as desired.

Compactness during use is of prime importance and the design of the end pieces or boards 11 and 12 enables warp 22 to be wound up in orderly fashion on one piece 11, and enables the weaving 23 to be wound up on the other board 12 thus when these are attached to fixed points 24 and 25 with their laces 14, only a short additional space is needed between the end pieces for the rigid heddle 13 to operate. As more warp 22 is needed, the warp board 11 can be unrolled one full turn providing more warp 22, and the finished weaving 23 may then be rolled up one full turn on the woven web board 12. several looms 10 can be attached by their laces 14 to the same fixed point 24, a tree or desk for example. The space needed for a loom is small enough that three looms could work easily in the back seat of a car with the front seat headrests used as the stationery objects 24 to which the warp boards 11 could be tied. In this case the woven web boards 12 could be attached to the weaver 25 for convenience, but in many cases the woven web board 12 can also be attached to a fixed object 25 and the weaver can sit or stand beside the loom while weaving if desirable. This is an advantage for teaching and demonstration situations where the weaver needs to maintain personal mobility, and an advantage when several people are working at the same time on the same loom.

Figure 5:
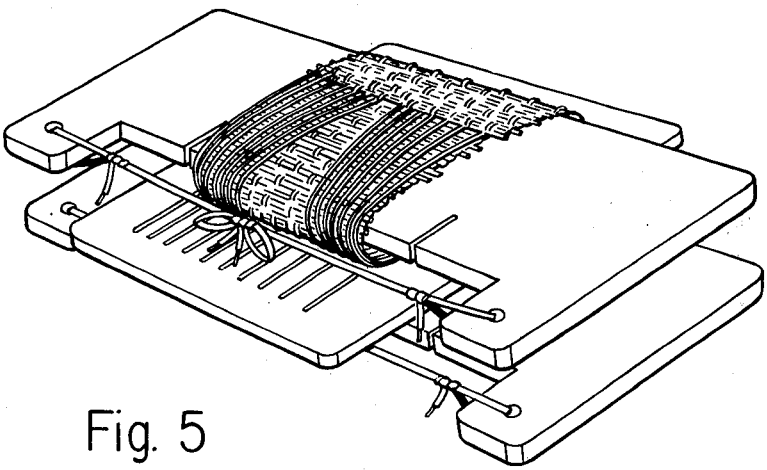

Ease of storage of work in progress FIG. 5 is provided by the design of the end boards 11 and 12 that enable the warp 22 and the work in progress 23 to be rolled up close together on their separate boards, with the heddle 13 held between, and then by tieing the lace 14 of each end board together with the other lace 14 of that same end board, no unrolling is possible. many looms can then be stored together without damage to work23 or warp 24 and without danger of their comming apart or getting mixed up with other things. One loom 10 can be stored in a large pocket, a handbag, or parhaps in the glove compartment of a car. The set up of a loom that has been stored this way is quick and easy. It consists of : Untieing the laces, Unrolling a short length of work 23 and warp 22, and tieing the boards 11 and 12 under tension to fixed objects 24 and 25.

Another main object of this invention is to let several people work together on the same loom 10 at the same time or in quick succession. This is provided by being able to tie both end boards 11 and 12 to fixed objects 24 and 25 so that a weaver can sit on either side of the work, pass the weft material back and forth between them, taking turns working the heddle 13 parhaps, or tradeing off with other people standing by, since no one is tied down to the weaving as with most backstrap looms. Several people can make a weaving 23 on the same warp 22, one after another, since it is easy to cut off a completed piece of weaving, tie knots in the remaining warp FIG. 3, 26, slip these knots 26 into the slots 17 of the woven web board 12, and start on the next piece. This is accomplished without rethreading the heddle 13, without making a new warp, and with very little loss of warp length.

Yet another object of the invention is to allow a wide variety of materials to be used for weft. Many low and no cost materials have great color and texture value for weaving, for example: weeds, rags, sticks or wood slats, strips of paper, and yarns and string of many sizes. Often these do not roll on the front beams of most looms because of length and thickness limitations of the space provided for roll on. Because of the design of the woven web board 12 of this loom 10, materials can be used for weaving that are both wider than the warp, and uneven in character FIG. 4 as the wind up of finished work on the woven web board puts very little tension, and no space limitations of length or bulk on the rolled up work. The projections 16 and laces 14 on the board will fit between long laterally extended weft materials if desired, and the only point of tension on the work is just at the point where it crosses the inside edge of the board 18.

In addition, it is possible to use these same end boards 11 and 12 for the ends of warps that have gone through more than one rigid heddle, thereby giving more than the two plain weave sheds, thereby making more complex weaving patterns possible for an advanced weaver, similar to possibilities of a three or more harness loom.

Special note should be made that no slipping of warp22 or rotation of the end boards 11 and 12 is possible during weaving while tension is maintained, because of the laces 14 being tied into holes 15 in the projections 16 from the edge 18 of the rectangular boards, in contrast to the slipping that occurs with warp or weaving that is fastened around a round or dowell like end piece. Rotation and unwinding is simple whenever desired by loosening the tension and turning the end boards one or more full turns.

Numerous objects and advantages of the invention have been set forth in the foregoing description, together wth details of the parts and function of the invention, and the novel features thereof are pointed out in the appended claims. The disclosure, however, is illustrative only, and changes may be made in detail especially in matters of size, shape,and number of heddles, within the principle of the invention, to the full extent indicated by the broad general meaning of the terms in which the appended claims are expressed.

What is claimed as new is:

1. An improved loom of the type having a pair of end members for securing and applying tension to opposite ends of warp threads and having an intermediate heddle, wherein the improvement comprises a pair of end members each end member formed with a series of spaced slots extending into an edge thereof and a tensioning cord means attached at its opposite ends to said end member more outward toward said edge than the bottoms of said slots for, under tension, orienting said slots in a direction opening away from the opposite end member.

2. A loom according to claim 1 wherein adjacent warp threads are knotted together near their ends to form groups, all the warp threads of each group extending through the same slot but having each group extending through a different slot, said threads being retained in the slots by said knots.

3. A loom according to claim 1 wherein said end member further comprises a rigid sheet having a pair of ears extending outwardly from said edge, one such ear being formed at each opposite end of said series of slots, and wherein said cord is attached to said ears.

4. A loom according to claim 1 wherein the opposite ends of the warp threads may be wound around said end members for compact storage.

* * * * *